United States Patent [19]

Hodson

[11] 4,225,247

[45] Sep. 30, 1980

[54] MIXING AND AGITATING DEVICE

[76] Inventor: Harry Hodson, Sarasota, Fla.

[21] Appl. No.: 19,154

[22] Filed: Mar. 9, 1979

[51] Int. Cl.[3] ..... B28C 5/16

[52] U.S. Cl. ..... 366/40; 366/65; 366/67; 366/312

[58] Field of Search ..... 366/65, 67, 66, 309, 366/310, 312, 320, 321, 325, 330, 279, 34, 35, 36, 40

[56] References Cited

U.S. PATENT DOCUMENTS

| | | | |
|---|---|---|---|
| 954,511 | 4/1910 | Gordon | 366/320 |
| 2,851,257 | 9/1958 | Morgan | 366/320 |
| 3,877,881 | 4/1975 | Ono | 366/312 |

*Primary Examiner*—Robert W. Jenkins

*Attorney, Agent, or Firm*—Arthur W. Fisher, III

[57] ABSTRACT

A mixing and agitating device specifically designed to mix a dry solid particle material such as cement with a liquid such as water in a high energy manner so as to provide a predetermined degree of hydration above that normally required in the formation of concrete or like cementitious material. A casing defining a container has on the interior thereof a plurality of agitating assemblies rotatably connected within the container and specifically structured and configured to provide a direction of material flow which is concurrently rotational about the axis of rotation of the agitating assemblies as well as along the substantial length of the container between the various spaced apart agitating assemblies so as to define a shear flow of the material resulting in a substantially constant and consistent viscosity and a predetermined degree of hydration, of the initially dry solid particles.

10 Claims, 5 Drawing Figures

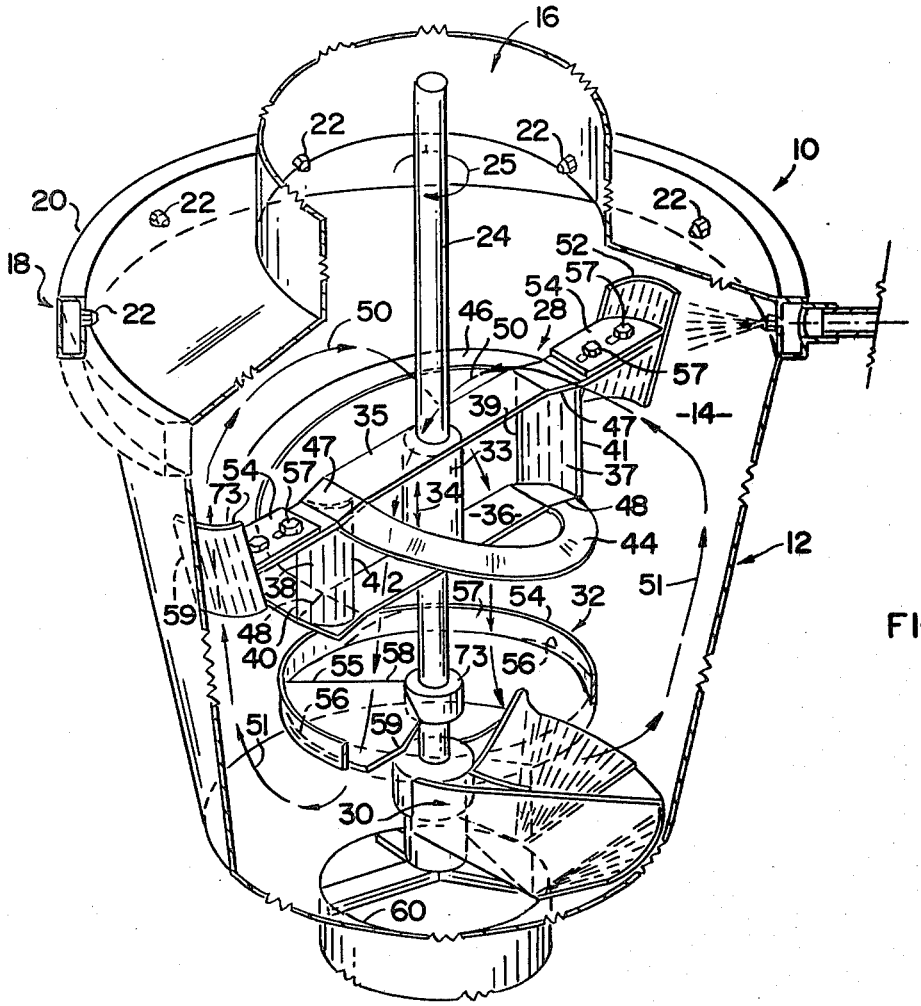
FIG.1
FIG.2
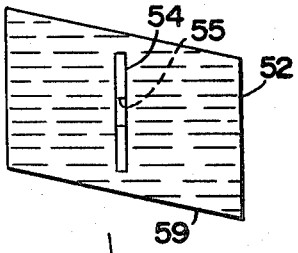
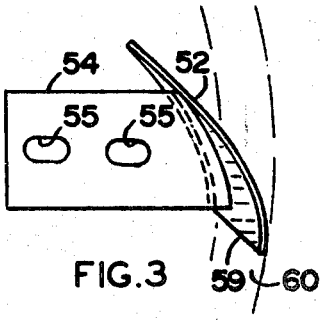
FIG.3
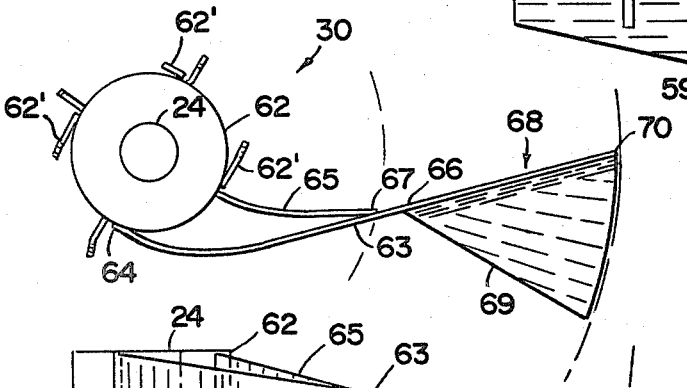
FIG.4
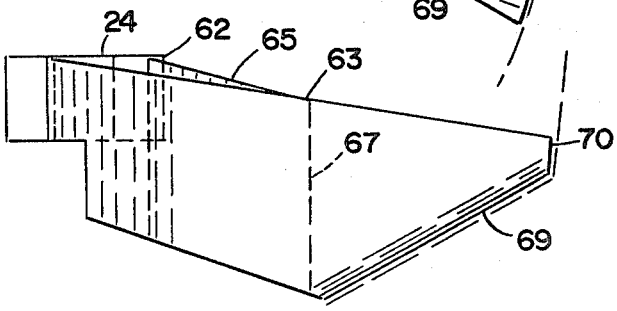
FIG.5

MIXING AND AGITATING DEVICE

BACKGROUND OF THE INVENTION

1. Field of the Invention

This invention relates to a mixing device or assembly specifically designed to mix solid particles such as cement particles in a high energy manner so as to accomplish a greater degree of hydration than normally provided in a conventional mixing assemblies used in the formation of concrete and like cementitious products.

2. Description of the Prior Art

As is well recognized in the construction and building industry concrete is used generically to define a collection or aggregation of materials which together form a reasonably continuous and consistent solid when cured. In conventional applications of concrete products voids and/or small discontinuities or inclusions of air within the resulting product are considered to be highly undesirable. This is true since such voids, etc. normally ffect the operating or performance characteristics of the product in a harmful manner.

However, in a certain specialized category of concrete such voids are intentional for the purpose of producing what is known as a porous concrete. While porous concrete is generally well known in the prior art such products frequently suffer from inherent problems, such as a weakness or a lack of structural integrity, which makes the overall product relatively undesirable.

The following U.S. Pat. Nos. disclose prior art products and/or methods of forming concrete products or cementitious material which is generally applicable but clearly distinguishable from the product which is formed through the utilization of the machine or assembly of the present invention: 2,710,802 to Lynch; 3,582,88, to Moore; 1,665,104, to Martienssen; 3,196,122 to Evans; 3,240,736, to Beckwith; 3,360,493, to Evans; 3,429,450, to Richards; 3,477,979, to Hillyer; 3,687,021, to Hinsley; 3,690,227 to Weltry; 3,870,422, to Medico; 2,130,498 to Klemschofski; 3,822,229, to McMaster.

The products of the type generally disclosed in the above set forth U.S. patents frequently suffer from certain inherent disadvantages. Such disadvantages include failure under heavy load or stress conditions as in highway construction. However, there is an acknowledged need in the construction industry, especially in the area of building roads, highways, bridges, etc. for a porous concrete type product having an even distribution of liquid flow therethrough. Such preferred porous concrete product should further be able to stand high load or stress conditions for high speed operation of large or heavy motor vehicles. Other uses of a porous concrete product are available once the desirable performance and operating characteristics of such a product has been established.

It is readily believed that the inherent failures set forth above are due to a failure to properly form the concrete product when utilizing conventional or currently known techniques as used in the formation of substantially conventional concrete or the like. Accordingly, there is an obvious need in the industry for mechanisms and processes of forming concrete utilizing conventional cement, water and aggregate components in a manner which will result in a finished porous concrete product having favorable operating and performance characteristics even under increased stress and high load conditions.

SUMMARY OF THE INVENTION

The present invention is directed towards a mixing assembly or device comprising a casing having a container defined on the interior thereof. The mixing assembly is specifically designed to mix solid particles such as cement particles with a compartable liquid such as water in a manner which will accomplish a consistent and continuous degree of viscosity. This is accomplished by mixing of the water and solid cement particles in a high energy manner to produce a high shear flow of material within the container of the mixing assembly. More specifically the casing is structured to include an inlet for the solid particles and a liquid inlet. In the preferred embodiment the liquid inlet directs a spray of water into engagement with the solid particles as they enter the casing. An outlet is formed in the casing, substantially at the opposite end thereof so as to direct the resulting viscous material or formed cementitious batch out of the interior of the container after a predetermined amount of mixing has been accomplished.

Agitating means in the form of a plurality of agitating assemblies are rotatably mounted on the interior of the container so as to rotate, all in the same direction about a centrally located drive shaft.

The drive shaft itself can be caused to rotate which in turn causes rotation of the plurality of agitating assemblies by means of a conventional drive motor or the like.

An important structural feature of the present invention is the provision of the agitating assemblies to be structured, configured and disposed relative to one another in a manner which will accomplish material flow during mixing, in both a rotational direction about the longitudinal axis of the drive shaft and in a direction substantially along the length of the interior of the container. The material being mixed is continually transferred from one agitating assembly to at least one other of the agitating assemblies in a manner which will direct the material in a "shear" type of flow pattern. This in turn accomplishes a greater degree of hydration of each of the cement solid particles than is normally accomplished in conventional mixing devices used in forming cementitious products or concrete. However, the degree of hydration achieved utilizing the device of the present invention is somewhat less than that achieved by what is commonly known as "wet milling" techniques. Such degree of hydration provides a resulting cementitious material batch which has a substantially continuous viscosity which defines a consistency which substantially eliminates "bleeding". For the purpose of the subject invention the term "bleeding" shall mean the normal separation of water from the cement particles as is common in the formation of conventional Portland cement type concrete.

The term high energy mixing can be used to define any type of mixing technique which accomplishes or effectively forces the more intimate contact between the water and the cement particles. The mixing assembly of the present invention, due to the specific dimension, disposition and configuration of its structural components accomplishes a shear flow of the product during its mixing operation. Such shear flow can best be defined by a complex, substantially counter and/or interruptive rotary flow path of the various portions of the cement and water concurrently as the entire cementitious material batch is being mixed. The term "batch" used herein is for purposes of clarity only and is not meant to limit the operation of the subject device to the production of material in independent or separated quantities. To the contrary, the device of the present invention is capable of operation on a continuous basis whereby a substantially constant supply of cementitious material is being produced and delivered from the subject mixing and agitating device.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a isometric view in partial cutaway showing the interior of the mixing and agitating device of the present invention.

FIG. 2 is an end view of one component structure of the agitating assembly of the present invention.

FIG. 3 is a top view of the embodiment of FIG. 2.

FIG. 4 is a top view in detail and partial cutaway of yet another structural feature of another of the plurality of agitating assemblies of the present invention.

FIG. 5 is a front view of the structure of FIG. 4.

Similar reference characters refer to similar parts throughout the several views of the drawings.

DETAILED DESCRIPTION OF THE PREFERRED EMBODIMENT

As best shown in FIG. 1 the subject invention is directed to a mixing and/or agitating device generally indicated as 10 which comprises a casing means 12 having a container means generally indicated as 14 defined on the interior thereof. The casing 12 has formed thereon inlet means in the form of a solid particle inlet 16 and a liquid inlet 18 respectively. With regard to the solid particle inlet 16 an aperture or opening is provided generally at the upper portion of the casing 12 with respect to the orientation of the casing as shown in FIG. 1, and is sufficiently dimensioned to allow solid cement particles to enter into the container 14 therethrough. Similarly the liquid inlet means 18 comprises a liquid carrying conduit 20 disposed about the periphery of that casing 12 and including a plurality of nozzles or spray elements 22 mounted on the conduit 20 and disposed on the interior of the casing 14 to direct liquid or water in the form of a spray into engagement with the solid particles as they enter through the solid particle inlet 16. Accordingly, the water is concentrated to contact the individual cement solid particles as the particles enter the container and somewhat prior to the combined water and cement particles being subjected to the agitating means as will be described in greater detail hereinafter.

With regard to the agitating means a substantially centrally located drive shaft 24 is disposed on the interior of the container 14 to extend substantially along the central longitudinal axis thereof. The drive shaft 24 is driven in a rotational manner as indicated by directional arrow 25 by a motor (not shown) preferably located on the exterior of the casing 12 and in driving relation to the drive shaft 24. Such a motor may be of any substantially conventional design and is not per se a part of the present invention. The motor serves as a driving force to cause drive shaft means 24 to rotate in a given direction indicated by directional arrow 25.

The agitating means of the present invention further comprises a plurality of agitating assemblies including first agitating assembly 29, second agitating assembly 30 and a third agitating assembly 32. Each of the agitating assemblies are interconnected to the drive shaft means 24 so as to be capable of rotational movement about the longitudinal axis thereof in the same direction (directional arrow 25).

More specifically the first agitating assembly is secured to the drive shaft means 24 by a bearing means 33. This bearing means is disposed in surrounding relation to the drive shaft means 24 and is further specifically structured to allow movement of the entire first agitating assembly 28 along the at least predetermined portions of the length of the drive shaft means 24. This movement is indicated by directional arrow 34. Such interconnection between the bearing means 22 and the drive shaft means 24 may take any conventional form so as to allow the adjustable and selective positioning of the first agitating assembly at various heights or positions along the drive shaft means 24. This movable and selective adjustment is provided due to the fact that, in the preferred embodiment of the present invention the entire first agitating assembly 28 should be submerged or mostly submerged below or substantially contiguous to the upper level of the cementitious material being mixed.

Further with regard to the first agitating assembly 28, such structure comprises at least two support blades 35 and 36 disposed in spaced apart substantially parallel relation to one another. Agitating blades 37 and 38 are disposed in spaced apart relation to one another on substantially opposite sides of the drive shaft means 24. The opposite ends of each of the agitating blades 37 and 38 is secured to one of the spaced apart support blades 35 and 36 such that the agitating blades 37 and 38 are disposed in substantially surrounding relation to the central longitudinal axis of the drive shaft means 24. In addition further structural features of the first agitating assembly comprise the agitating blades 37 and 38 each having a substantially curvilinear configuration wherein the leading edge 39 and 40 of each blade 37 and 38 respectively is disposed substantially outwardly to the respective trailing edges 41 and 42 of the agitating blades 37 and 38 respectively relative to the central longitudinal axis of the drive shaft means 24. This provides a rotary or rotational flow path of the material being mixed while at the same time forcing such material inwardly of the rotating blades.

The first agitating assembly 28 of the present invention further comprises a second pair of agitating blades including substantially elongated and curvilinear configurations 44 and 46 each having its leading edge as at 47 secured to the uppermost support blade 35 and the trailing edge 48 thereof secured to the lowermost support blade 36. Therefore each of the second agitating blades 44 and 46 are disposed to extend over and between different heights or lengths along the longitudinal axis of the drive shaft means 24. Their respective curvilinear configurations also effectively dispose the second agitating blades 44 and 46 in surrounding relation to the drive shaft means 24. These specific configurations of these second agitating blades 44 and 46 cause a concurrent rotational and downward movement of the material being mixed as indicated by directional arrows 50.

Finally the first agitating assembly 28 comprises a pair of cleaning and collecting blades 52 and 53 attached to the outward extension of the uppermost support blade 35 by support tongues 54.

With specific reference to FIGS. 2 and 3 reference will be had to the structural details of cleaning blade 52 and attached support tongue 54. However, it should be noted that the structural features as well as the disposition of each of the cleaning blades 52 and 53 are the same and for purposes of clarity only the one structure 52 and attached supporting tongue 54 will be discussed. Support tongue 54 has apertures 55 formed therein for the purpose of attachment to the outward extension of the upper support blade 35. Such attachment occurs through conventional connectors as at 57. The provision of the elongated slots 55 allows the outward or inward adjustment of each of the cleaning blades 52 relative to the elongated axis of the upper support blade 35. Accordingly, each of the blades 52 and 53 may be adjusted radially towards or away from the central axis of the drive shaft means 24 to accommodate for the various pre-selected heights at which the overall first agitating assembly 28 is mounted relative to the length of the drive shaft means 24. Again with reference to FIG. 3 it is important that the leading edge 59 of each of the cleaning blades 52 and 53 be immediately adjacent to the interior surface 60 of the container 14 so as to clean or remove any material which would have a tendency to cling to such surface 60 and harden thereon.

It should be noted that any means of attaching the cleaning blades 52 and 53 so as to be movable radially towards and away from the longitudinal axis of the drive shaft means 24 may be utilized to accomplish selected positioning of the cleaning blades 52 and 53 so as to properly clean or remove formed material from the interior surface 60 of the container 14.

Again with reference to FIGS. 1, 4 and 5 the agitating means of the present invention further comprises a second agitating assembly 30 which is spaced apart along the longitudinal axis of the drive shaft means 24 from the first agitating assembly 28 and also from the third agitating assembly 32 which will be described in greater detail hereinafter. The second agitating assembly comprises a connecting bearing structure 62 serving to surround and secure the second agitating assembly 30 to the drive shaft means 24. The second agitating assembly 30 comprises a plurality of mixing blades 63 disposed in equally spaced apart relation to one another about the connecting bearing assembly 62 and extending radially outward therefrom. With reference to FIGS. 1 and 2 the individual mixing blades 63 are represented by the provision of a single mixing blade 63 for purposes of clarity. However each of the mixing blades, are shown connected by their junction point as at 62 thereby defining their substantial point of connection of the connecting edge 64 with the bearing assembly 62.

A support element 65 is disposed in interconnected relation between an outer surface of the baring assembly 62 and a trailing surface 66 of the blade 63 as at 67. Each of the mixing blade 63 are characterized by their outer or distal end generally indicated as 68 having a curvilinear configuration. Such curvilinear configuration is further defined by the leading edge 69 being disposed somewhat lower and in front of, relative to the direction of rotation (directional arrow 25), then the trailing edge 70. This curvilinear configuration of the distal end as at 68 provides a "scoping" action attending to lift the mixed material being directed from the first and third agitating assemblies down towards the area of the second agitating and therefrom upwardly along the length of the container 14 back towards the first agitating assembly as indicated by directional arrow 51.

Further with regard to FIG. 1 the agitating means of the present invention further comprises a third agitating assembly 32 which is also secured to the drive shaft means 24 by a conventional connecting bearing as at 73. By virtue of this connection the third agitating assembly 32 rotates about the longitudinal axis of the drive shaft means 24 in the same direction as the first drive assembly 28 and the second drive assembly 30. (Direction arrow 25). The structure of the third agitating assembly 32 is such as to comprise an outer ring or annulus 54 defining the outer peripheral portion of the third agitating assembly 32. A plurality of fan blades 55 are disposed in interconnected relation between the connector or bearing element 73 and the outer annulus 54. For purposes of clarity FIG. 1 shows only a single blade 55, however, junction points 56 shown in broken lines on the inner surface 57 of the annulus 54 serves to indicate the position of interconnection or junction between the outermost edge of each of the blades 55 and the inner surface 56 of the annulus 54. In any event each of the fan blades comprises a leading edge 58 which is disposed somewhat higher relative to the orientation and length of the longitudinal axis of the drive shaft means 24 then the trailing edge 59 of the same blade 55. By virtue of this configuration, the constant rotary motion about the longitudinal axis of the drive shaft 24, and the provision of a plurality of such blades 25 disposed in equally spaced relation to one another, a continued rotary action or path of travel of the mixed cementitious material is created as well as a downward driving force of the material from the first assembly 28 through the third assembly 32 and down to the area of the second assembly 30.

Upon complete mixing the cementitious material is exited from the interior or container 14 through a conventional outlet structure indicated by outlet aperture 60. Any type of outlet can in fact be provided from the container 14 so as to efficiently and adequately remove the cementitious material either in a batch form or on a continuous basis dependent upon the rate of feed of the drive particle, cement and water to the interior of the container 14.

Another structural feature of the present invention comprises the provision for a connecting means (not shown) connectible contiguous to or immediately adjacent the inlet 16. Such a structure may take any of a variety of configurations but must be adaptable for proper mounting to casing 12 in a manner so as to secure a removably attached container thereto. This container may be designed to hold the cement dry particles prior to mixing and as applied to the casing 12 so as to allow flow through of the particles into the interior of the casing 12 or the container 14 for the purpose of mixing in a batch type method. It should be noted, and as emphasized above, that absent the provision of suppling the cement particles to the interior of the container 14 in a batch type manner, such dry particles as well as the water can be simultaneously added to the container 14 on a continuous basis. In the latter embodiment the mixed cementitious material will exit from the outlet 60 on the same type of continuous basis.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A mixing assembly of the type primarily designed to accomplish a predetermined degree of hydration of solid particles, said assembly comprising: casing means defining container means on the interior thereof and including inlet means configured to receive both solid particles and liquid therethrough and thereby including liquid inlet means and solid inlet means structured independent of one another, said liquid inlet means comprising a spray assembly disposed and structured to direct liquid in spray form into contact with the incoming solid material at various spaced apart points along the periphery of said container; agitating means comprising a plurality of agitating assemblies movably mounted on the interior of said casing means and disposed along a predetermined portion of the length of said container means in at least partially spaced apart relation from one another, outlet means disposed down stream of said inlet means relative to said agitating means, said agitating means disposed, configured and structured to provide a flow of the mixed material concurrently in a direction around the central axis of said container and in a direction along a predetermined portion of the length of said container between opposite ends of said container, whereby shear flow of the mixed material is established.

2. A mixing assembly as in claim 1 wherein said plurality of agitating assemblies comprise at least a first and second agitating assembly disposed in longitudinally spaced apart relation to one another and connected to a drive shaft means so as to rotate about the longitudinal axis thereof, at least one of said first and second agitating assemblies adjustably connected to move along the length of said drive shaft means.

3. A mixing assembly as in claim 2 further comprising a third agitating assembly connected to said drive shaft means to rotate about the longitudinal axis thereof and disposed between said first and second agitating assemblies and including a plurality of fan blades each angularly inclined to a plane of rotation of said third agitating assembly such that the leading edge of each of said fan blade is substantially above the trailing edge thereof relative to the longitudinal axis of said drive shaft means.

4. A mixing assembly as in claim 3 wherein said plurality of agitating assemblies each rotate on the interior of said container, said third agitating assembly so structured to direct material flow at least partially from said first agitating assembly to said second agitating assembly.

5. A mixing assembly as in claim 2 wherein said plurality of agitating assemblies comprise at least a first agitating assembly including at least two support blades disposed in spaced apart, substantially parallel relation to one another and connected to a centrally located drive shaft means to rotate about the axis thereof, agitating blade means including a substantially elongated and curvilinear configuration at least partially surrounding said drive shaft, said agitating blade means interconnected between said two support blades at opposite ends of said agitating blade means, said support blades and said agitating blade means cooperatively configured and disposed to direct material flow concurrently about the axis of rotation of said first agitating assembly and along the length of said container toward the remaining portion of said agitating means.

6. A mixing assembly as in claim 5 wherein said agitating blade means comprises a plurality of agitating blades each including a substantially elongated and curvilinear configuration disposed in at least partially surrounding relation to said drive shaft means, each of said agitating blades having a leading end portion attached to an upper one of said support blades and a trailing edge portion attached to a lower one of said two supporting blades.

7. A mixing assembly as in claim 5 wherein said first agitating assembly further comprises cleaning blade means connected to rotate about the longitudinal axis of said drive shaft and extending radially outward therefrom, said cleaning blade means comprising at least one cleaning blade disposed substantially adjacent an interior surface portion of said container, said cleaning blade further disposed at a predetermined angular inclination substantially corresponding to the angular inclination of the correspondingly positioned interior surface portion of said container.

8. A mixing assembly as in claim 7 wherein said one cleaning blade is movably connected to said first agitating assembly so as to move radially in a direction transverse to the longitudinal axis of said drive shaft.

9. A mixing assembly as in claim 1 wherein said plurality of agitating assemblies comprise at least a first and second agitating assembly connected to a drive shaft and disposed to rotate about the longitudinal axis thereof, said second agitating assembly disposed in spaced apart relation from said first agitating assembly and comprising a plurality of mixing blade extending outwardly from said drive shaft, at least one of said mixing blades specifically configured and angularly oriented relative to it own longitudinal axis, whereby direct material flow is directed therefrom substantially along the length of said container between said first and second agitating assemblies.

10. The mixing assembly as in claim 9 wherein said plurality of mixing blades are connected to and extend radially outward from said drive shaft, at least one of said mixing blades having its distal end comprising a curvilinear configuration, a leading edge of said distal end disposed farther from said first agitating assembly than a trailing edge of said distal end, whereby material flow is directed both rotationally about the axis of rotation of said second agitating assembly and from said second agitating assembly toward said first agitating assembly.

* * * * *